US006461014B1

(12) United States Patent
Lin

(10) Patent No.: US 6,461,014 B1
(45) Date of Patent: Oct. 8, 2002

(54) ORNAMENTAL DEVICE WITH THERMAL CYCLE OF FLAME

(76) Inventor: Yung Chang Lin, No. 10, La. 105, Pao Tsing Street, Taipei (TW)

( * ) Notice: Subject to any disclaimer, the term of this patent is extended or adjusted under 35 U.S.C. 154(b) by 100 days.

(21) Appl. No.: 09/654,899

(22) Filed: Sep. 5, 2000

(51) Int. Cl.[7] ..... F21V 33/00

(52) U.S. Cl. ..... 362/101; 362/161; 362/806

(58) Field of Search ..... 362/168, 35, 96, 362/294, 373, 806, 8, 161, 166, 167; 40/406, 407, 409, 411, 412, 422, 439, 440, 441, 477, 479, 480

(56) References Cited

U.S. PATENT DOCUMENTS 4,163,333 A * 8/1979 Kwiatkowski ..... 362/806
4,170,035 A * 10/1979 Walker ..... 362/806
5,778,576 A * 7/1998 Kaviani ..... 40/409

* cited by examiner

*Primary Examiner*—Y. My Quach-Lee
(74) *Attorney, Agent, or Firm*—Troxell Law Office PLLC

(57) ABSTRACT

An ornamental device with thermal cycle of flame includes a heating section, and an exhibition section. The heating section has a base frame with an open top, the base frame providing a combustion room with an air aperture, the combustion room holding a combustible at a proper distance between the combustible and the open top. The exhibition section is an enclosed exhibiting container astride the base frame, containing a fluid medium of proper level to form an air chamber, and one or more exhibits being provided in the fluid medium. Once the combustible is lit, the flame heats up the fluid medium in the exhibiting container to a temperature of circulation. The fluid medium may generate a thermal cycle and circulate in the exhibiting container such that the exhibits may move with the circulating fluid medium and generate an effect of dynamic exhibition of tumbling upward and downward or floating and submerging alternately.

16 Claims, 6 Drawing Sheets

ORNAMENTAL DEVICE WITH THERMAL CYCLE OF FLAME

BACKGROUND OF THE INVENTION

1. Field of the Invention

The present invention relates to an ornamental device with thermal cycle of flame, and particularly to an ornamental device having exhibits in a container with fluid media presenting a dynamic effect by way of flame on a burned combustible heating up the fluid media to generate a thermal cycle.

2. Description of Related Art

It is known that decorations such as metal pieces in liquid resulting in a dynamic exhibiting effect of tumbling upward and downward by using the thermal cycle has been disclosed for years. For instance, Taiwanese utility model application No. 79203163 entitled "illuminator with decorating effect" is a typical example and the prior art is composed of an illumination section and a lighting section. The illumination section is a light penetration resistant base box with a guide ring (lamp socket) therein and a light bulb is located in the guide ring. The guide ring and the light bulb connect with a pole of the power source respectively. The lighting section is disposed astride the base box and is a transparent container (receiver) filling with liquid and receiving a plurality of floats. Once the power is on, the light and heat generated by the light bulb is transmitted toward the bottom of the transparent container. The liquid in the container may undergo circulation after being heated up for a period of time and the floats therein may tumble upward and downward to result in an effect of dynamic exhibition.

Besides, the related suppliers continuously improve the prior art and apply the liquid wax instead of said floats (decoration pieces). When the liquid wax is heated up to a certain extent by the light bulb, the wax has the specific weight thereof reduced and floats in the liquid as pieces. Furthermore, the wax pieces on the liquid level are cooled down and their specific weights become greater based on the temperature difference between the top and the bottom of the container such that the wax pieces then submerge again. Thus, the wax pieces circulate to move downward and upward and an effect of dynamic exhibition can be obtained physically.

It can be found that the light and the heat are generated by the light bulb and power source in the prior art. In fact, there are certain deficiencies for the prior art and they will be described in detail hereinafter:

1) The site to place the prior art of decorative illuminator is restricted, that is, the prior art of decorative illuminator is useless in a place such as outdoors where no power source is available.

2) Because the voltage specification such as 110V or 220V applied is not unified in all nations and there are different types of sockets such as two electrodes, three electrodes, and etc., it is necessary for the decoration illuminator to be made specifically for different electric regulations that results in a greater risk for preparing more spare parts for inventory.

3) Electric products selling in the market have to comply with strict safety codes and buyers of imported goods usually demand the local safety regulations be met such as GS for Germany, UL for United States, and etc. Hence, it makes an increase of cost and a prolonged time of product development. Because the preceding said decoration illuminator uses a light bulb to emit light and heat by way of the electrical power, it is restricted by the safety regulations of certain countries such that the decoration illuminator can only be used indoors unless a special treatment of waterproof is performed.

4) There is a problem related to replacement and repair of parts. The light bulb has a limited durability and it has to be often replaced by the user. But, how to get a light bulb with identical specifications and the inconvenience of disassembling and assembling the transparent container and the base box are bothering the user.

Although electricity has been used instead of fire for illumination, the lead wire, the plug, the socket, the lamp socket, and the light bulb are required. Nevertheless, the fire has its practical application. For instance, candles are used for enhancing romantic air in a night banquet and is the first choice for offering illumination in case the power is off.

SUMMARY OF THE INVENTION

An object of the present invention is to provide an ornamental device with a thermal cycle by flame, which is not required to use an electric power source and which can be exhibited outdoors as well as indoors.

Another object of the present invention is to provide an ornamental device with a thermal cycle by flame, in which the combustible material is replaced easily and enhances the dynamic decoration effect.

A further object of the present invention is to provide an ornamental device with a thermal cycle by flame, which offers visional amusement and educational demonstration.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
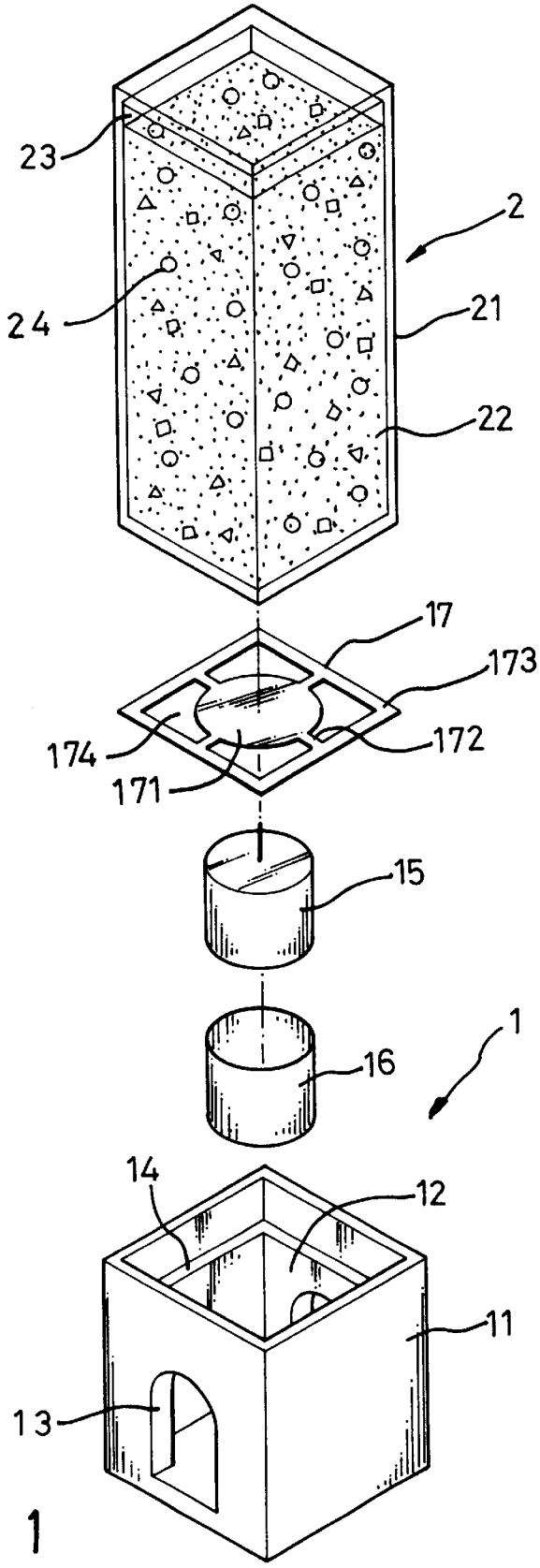
FIG. 1 is an explodes perspective view of ornamental device with thermal cycle of flame according to the present invention.
Figure 2:
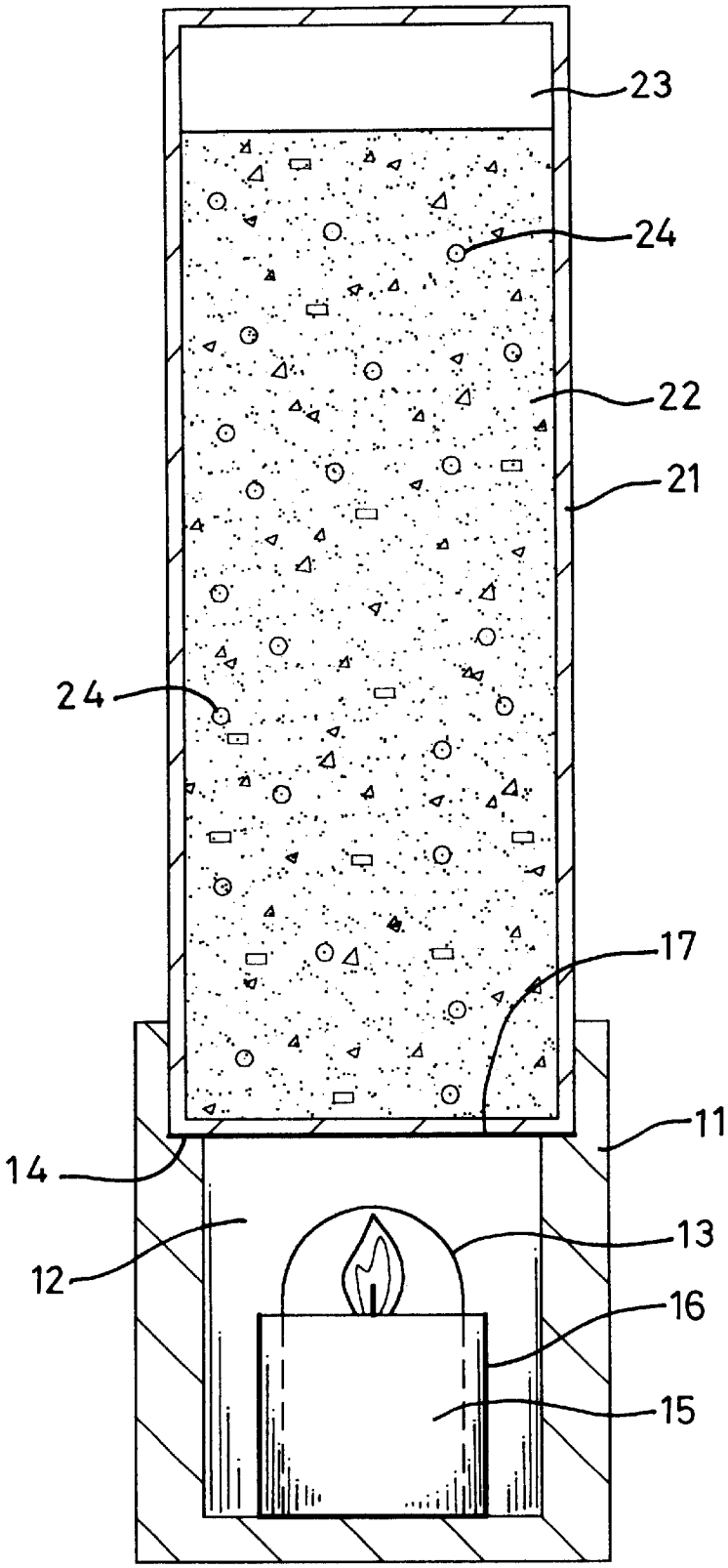
FIG. 2 is a sectional view of FIG. 1 after assembled.
Figure 3:
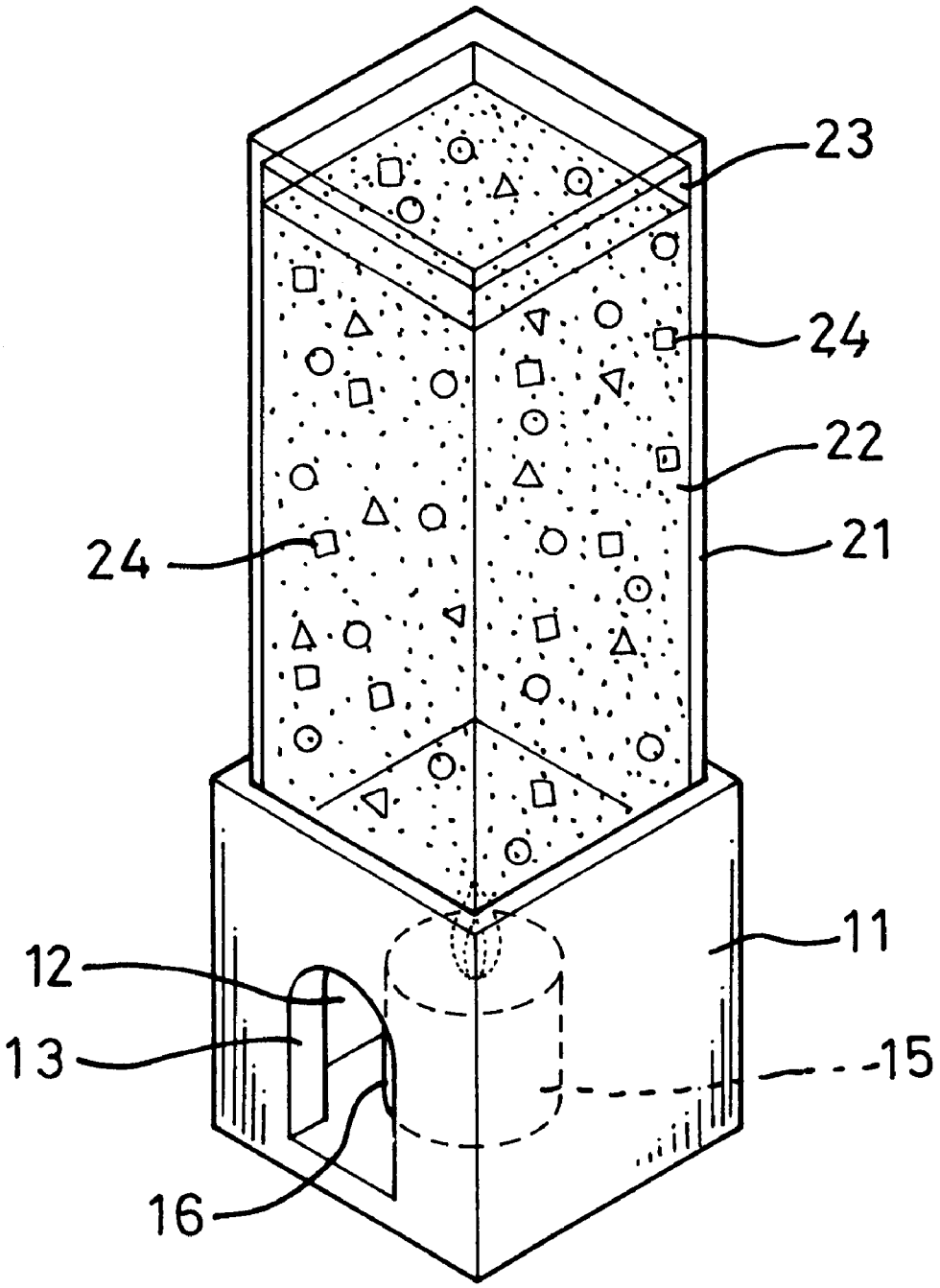
FIG. 3 is an assembled perspective view of FIG. 1.

Referring to FIGS. 1, 2, and 3, basically, an ornamental device with a thermal cycle by flame comprises a heating section 1 and an exhibition section 2.

The heating section 1 is a device having the light source and the heat source and has a base frame 11 with opening top to be straddled by and located below the exhibition section 2. The base frame 11 provides a combustion room 12 with at least an air aperture 13 therein as an air passage. Besides, a combustible 15 in a state of solid or liquid such as candle, solidified alcohol block, alcohol, burning oil, or the like is placed in the combustion room 12. It is noted that a proper distance between the combustible 15 and the top of the base frame 11 has to be kept while the combustible 15 is disposed in place.

Furthermore, the base frame 11 can be made in any configuration such as rectangle, circle, or polygon, and preferably, has the same configuration as the exhibiting container 21 of the exhibition section 2 to enhance the visual sense of beauty. Besides, the base frame 11 may be made of transparent or non-transparent material and preferably the transparent material is adopted to make the base frame 11 provide illumination. In addition, the base frame 11 near the opening top thereof has an intersection step 14 around the inner wall thereof to be straddled by and locate the exhibition section 2 such that the heating section 1 can be associated with the exhibition section 2 firmly. In order to obtain a prolonged time of burning for the combustible 15, it is preferable that the combustible 15 is contained in a receiver 16, which may avoid random blowing of the burned liquid.

The exhibition section 2 is the exhibiting container 21 being disposed on the base frame 11 and the exhibiting container 21 is enclosed and contains a fluid medium 22 of liquid at a proper level. Thus, an air chamber 23 is formed to offer an expansion space for heated fluid medium 22. In addition, one or more exhibits 24 such as decoration, solid/liquid wax or pearl paste is/are provided in the fluid medium 22 to move along with the circulation of the fluid medium 22. Thus, a phenomenon of [exhibit] tumbling upward and downward or floating and submerging continuously generates an effect of dynamic exhibition.

Furthermore, a heat guiding pad 17 may be disposed between the exhibition section 2 and the base frame 1 to avoid the flame of the combustible 15 directly contacting the bottom of the exhibition section 2. The heat guiding pad 17 has a central circular plate 171, an enclose frame 173 corresponding to the intersection step 14, and a plurality of connecting ribs 172 associated with the frame 173 and the circular plate 171. When the circular plate 171 is heated by flame, the heat may move upward through the empty areas 174 between the connecting ribs 172 to constitute indirect heating.

Referring to FIGS. 1 to 3 again, the operation of the ornamental device with a thermal cycle by flame will be explained hereinafter. First of all, light up the combustible 15 such as a candle and then place the exhibiting container 2 astride the intersection step 14 in the base frame 11. In the meanwhile, the flame on the candle keeps heating up the fluid medium 22 such as liquid in the exhibition container 21. When the circulation temperature of liquid 22 is reached, the liquid 22 may generate a thermal cycle to circulate in the exhibition container 21. Thus, the exhibits 24 such as decoration pieces may move circularly along with fluid medium 22 to form a dynamic effect of tumbling upward and downward. Moreover, the exhibits 24 can reflect the light on the candle to constitute an exhibiting effect of lighting variation.

Figure 4:
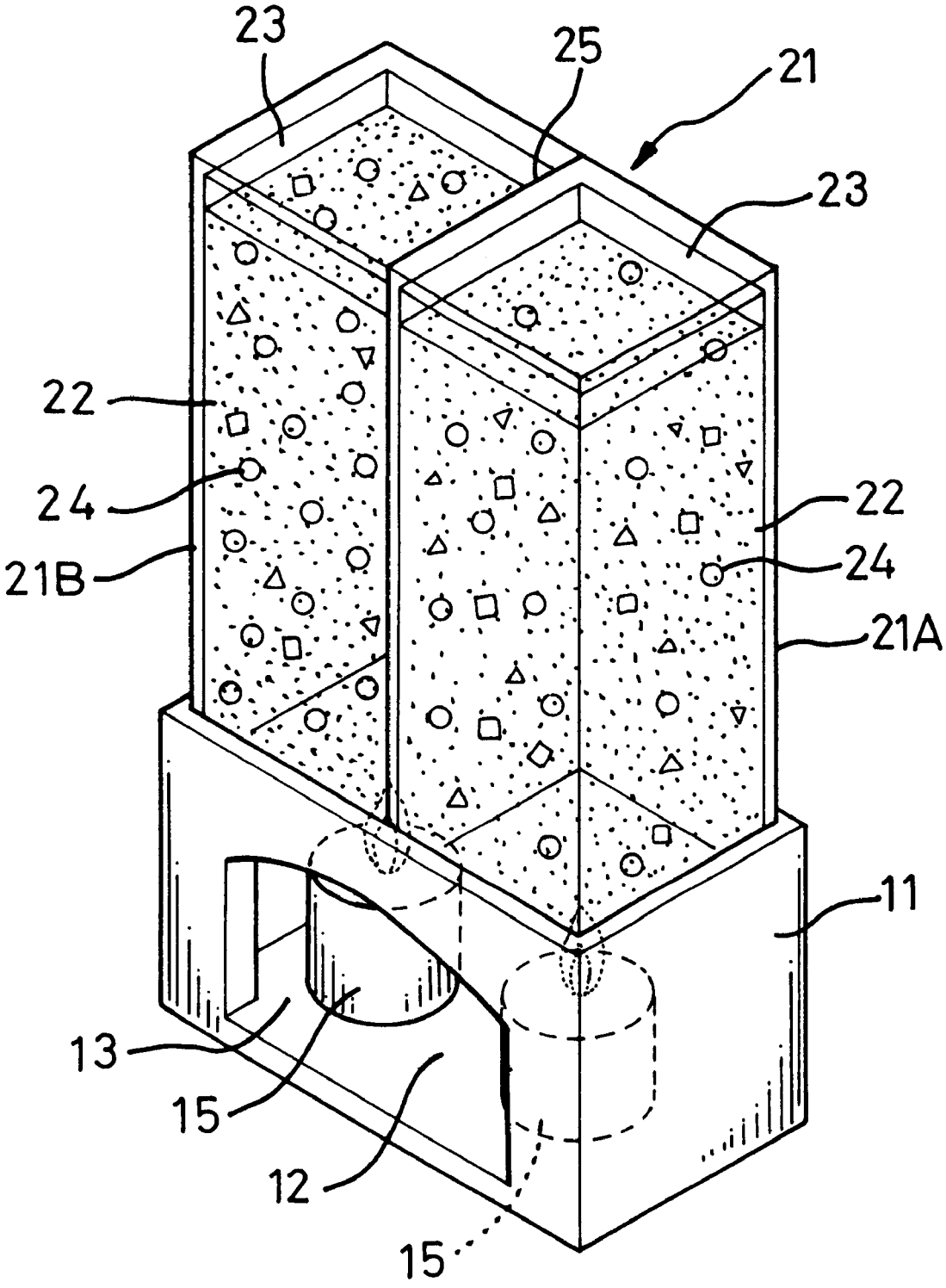
FIG. 4 is another perspective view of the present invention illustrating a second embodiment thereof.

Referring to FIG. 4, another embodiment of the present invention illustrates a partition 25 is longitudinally provided in the exhibition container 21 to form two separate containers 21A and 21B. The color of fluid medium and the aspect of each exhibit in the container 21A are different from those in the container 21B. A respective combustible 15 can be provided to correspond to the bottom of the respective container 21A, 21B or a combustible 15 with two burners is provided to generate two flames for heating both of the containers 21A, 21B. Hence, a greater illumination can be obtained and more upward and downward tumbling varieties and vivid lighting effect can be exhibited.

Figure 5:
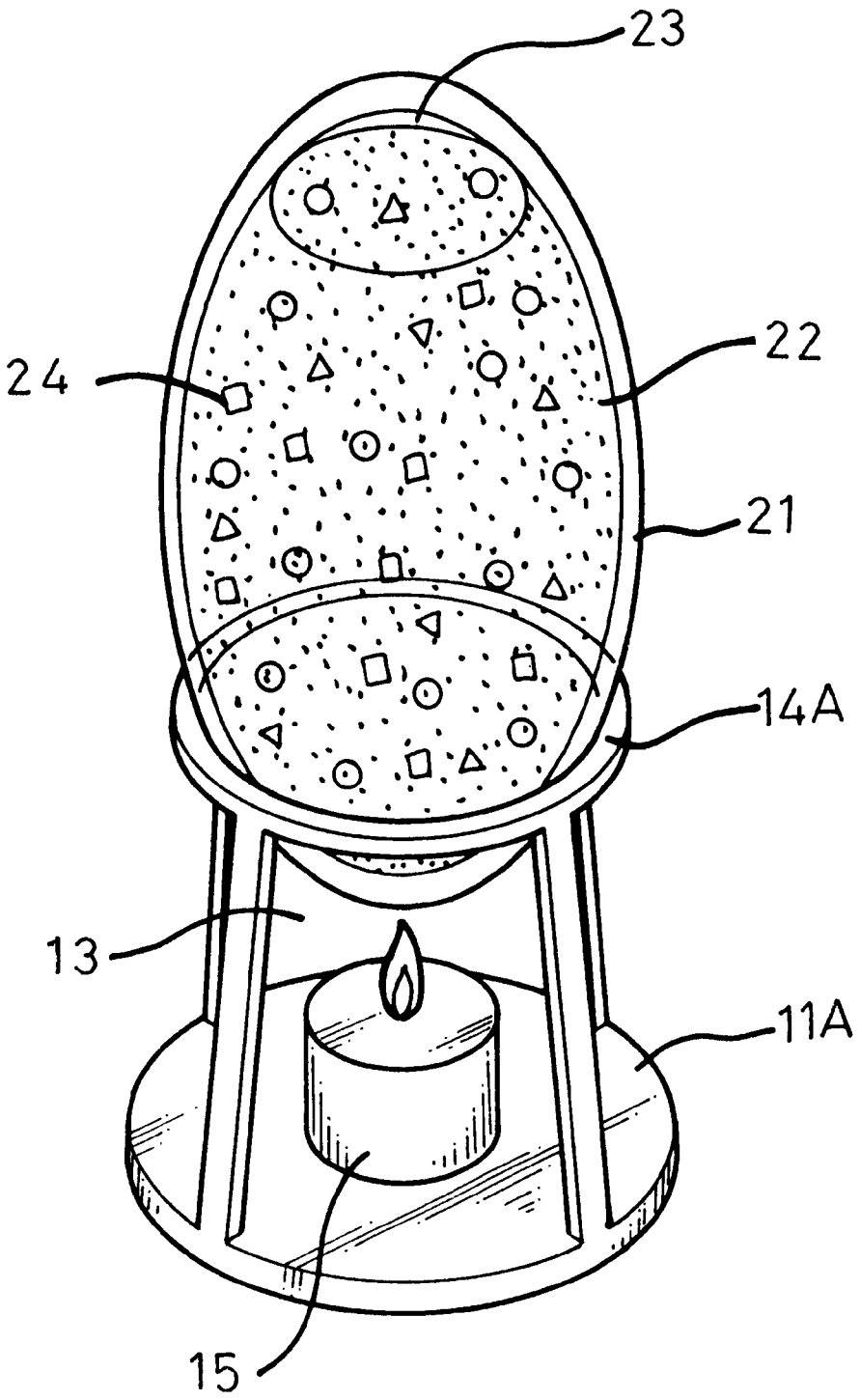
FIG. 5 is a further perspective view of the present invention illustrating a third embodiment thereof.

Referring to FIG. 5, a further embodiment of the present invention is illustrated. The embodiment provides an opening frame stand 11A and an annular support 14A respectively instead of the base frame 11 and the intersection step 14 shown in the preceding embodiments. The embodiment implies the present invention can offer a variety of configurations and handiness in use.

Figure 6:
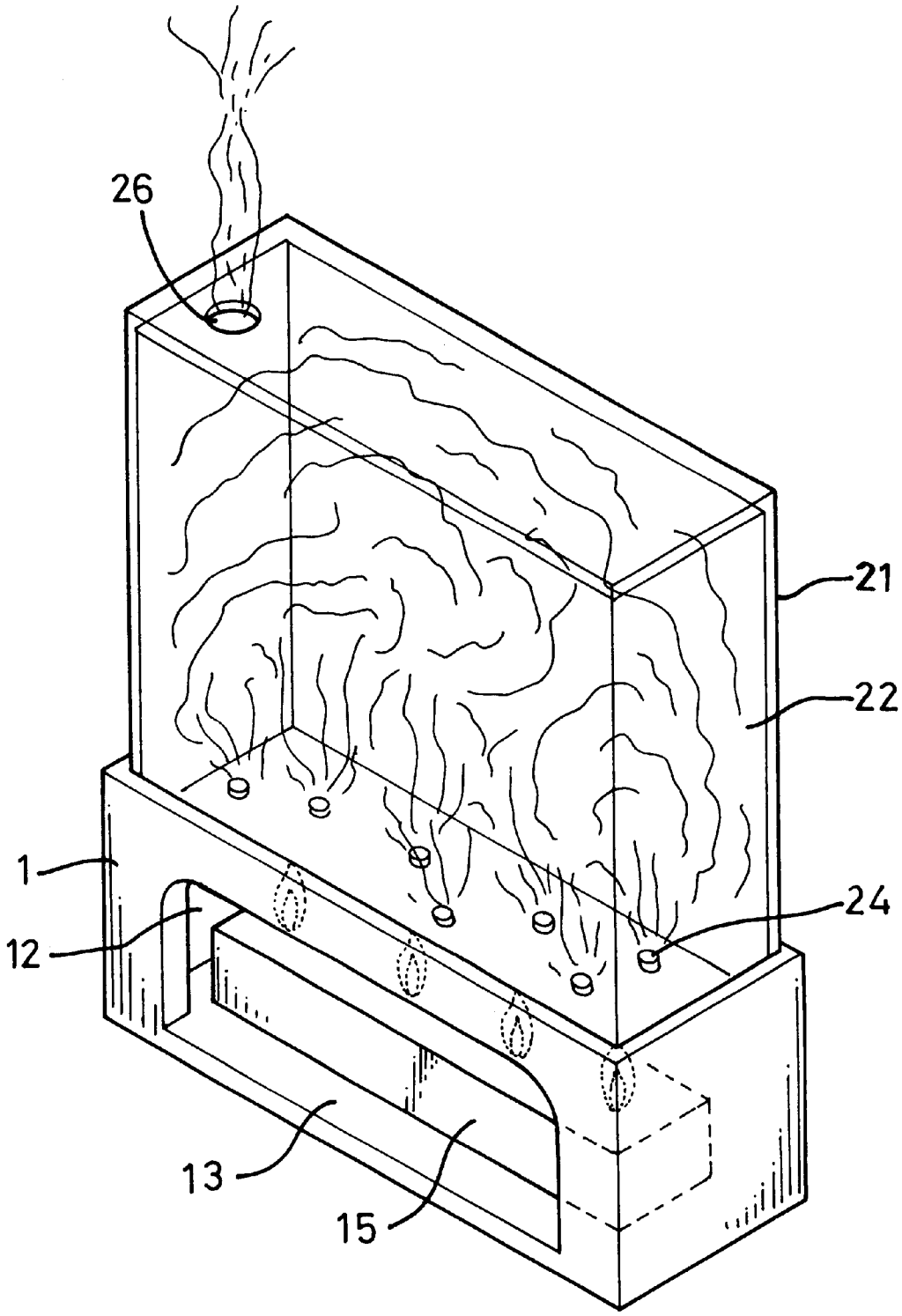
FIG. 6 a further perspective view of the present invention illustrating a four embodiment thereof.

Referring to FIG. 6, a further embodiment is illustrated. The fluid medium 22 in the exhibition container 21 is air and an air aperture 26 is disposed to locate at a proper spot on the container 21 for admitting the exhibit 24 such as a smoke maker like dry ice. The exhibit 24 may gasify gradually at a normal temperature and the lower part of the container 21 is then full of the smoke. When the combustible 15, which is in a type of single pieces or multiple pieces, is lighted up to make the fluid medium 22 flow in circulation and the smoke made by the exhibit 24 flows slowly to dissipate outward gradually through the air aperture 26.

It is appreciated that the advantages of the ornamental device with a thermal cycle by flame according to the present invention in practice can be summarized as follows:

1) There is no restriction of exhibition site. The combustible such as candle, which is used for heating and illumination, is readily available on the market. Because no power source and light bulb are required, it can be used indoors or outdoors and the exhibition site is not limited.
2) It is appropriate to be used anywhere in the world. Because no power source and light bulb are necessary, it is not necessary to consider the specified voltage and plug specification of each country in case of selling the ornamental device of the present invention around the world. In addition, the base frame can be made shorter in height since there is no lamp stand and no light bulb.
3) There is no need to consider safety regulations of electric appliances. The combustible adopted in the ornamental device of the present invention has been used for years without any safety problem and it is easy to obtain. Therefore, the present invention does not have to have relation to the safety regulation of electric appliance.
4) A faster reaction time can be reached. It is known that the heat emitted by the light bulb is transmitted radially to act on the exhibition container such that a slow temperature rise can be reached. Nevertheless, the present invention applies the flame to heat up the bottom of the base frame directly or indirectly by way of point contact such that the fluid medium can have a local temperature rise easily and reach the temperature of circulation swiftly to reduce the reaction time.
5) It is easy to replace the combustible. The combustible adopted in the present invention is handy to get and is easy to be replaced a new one in case of the old combustible is run out. Therefore, there is no chance to touch the electric power source carelessly.
6) It is full of romantic air. The ornamental device of the present invention can be used as a candle stand such that a spectacular and amusing effect can be enhanced in addition to keeping the original features of candle.
7) It is full of a sense of education. The ornamental device of the present invention allows the children understand theories of physics such as fire generating light and heat, heat cycle of convection, and effect of the specific weight relative to the temperature.

While the invention has been described with reference to a preferred embodiment thereof, it is to be understood that modifications or variations may be easily made without departing from the spirit of this invention, which is defined by the appended claims.

What is claimed is:

1. An ornamental device with a thermal cycle by flame, comprising:

a heating section having a base frame with an open top, the base frame including a combustion room with at least one air aperture therein, the combustion room containing a combustible; and an exhibition section including an enclosed exhibiting container astride the base frame, the exhibiting container containing a liquid at a predetermined level and forming an air chamber therein, and at least one exhibit provided in the liquid;

whereby, a flame from the lit combustible heats up the liquid in the exhibiting container to a circulation temperature causing the liquid to circulate in the exhibiting container such that said at least one exhibit moves with the circulating liquid.

2. The ornamental device with a thermal cycle by flame as defined in claim 1, wherein the base frame near the open top thereof has an intersection step around an inner wall thereof engaged by the exhibition section.

3. The ornamental device with a thermal cycle by flame as defined in claim 1, wherein the combustible is one of a solid or liquid.

4. The ornamental device with a thermal cycle by flame as defined in claim 1, wherein the combustible is contained in a receiver.

5. The ornamental device with a thermal cycle by flame as defined in claim 1, wherein the at least one exhibit is selected from the group consisting of solid/liquid wax and pearl paste.

6. The ornamental device with a thermal cycle by flame as defined in claim 1, wherein a heat guiding pad is provided between the base frame and the exhibiting container.

7. The ornamental device with a thermal cycle by flame as defined in claim 6, wherein the heat guiding pad further comprises a central circular plate, an enclosing frame having an outline corresponding to the base frame, and a plurality of connecting ribs connecting the central circular plate to the enclosing frame.

8. The ornamental device with a thermal cycle by flame as defined in claim 1, wherein the base frame is made of transparent material.

9. An ornamental device with a thermal cycle by flame, comprising:

a heating section having a base frame with an open top, the base frame including a combustion room with at least one air aperture therein, the combustion room containing a combustible; and an exhibition section including an enclosed exhibiting container astride the base frame, the exhibiting container containing air and having an air aperture therein, and smoke making exhibits located on a bottom of the exhibiting container;

whereby, a flame from the lit combustible heats up the air in the exhibiting container to a circulation temperature causing the air to circulate in the exhibiting container such that smoke from the smoke making exhibits flows with the circulating air.

10. The ornamental device with a thermal cycle by flame as defined in claim 9, wherein the base frame near the open top thereof has an intersection step around an inner wall thereof engaged by the exhibition section.

11. The ornamental device with a thermal cycle by flame as defined in claim 9, wherein the combustible is one of a solid or liquid.

12. The ornamental device with a thermal cycle by flame as defined in claim 11, wherein the combustible is contained in a receiver.

13. The ornamental device with a thermal cycle by flame as defined in claim 11, wherein said exhibits are dry ice.

14. The ornamental device with a thermal cycle by flame as defined in claim 9, wherein a heat guiding pad is provided between the base frame and the exhibiting container.

15. The ornamental device with a thermal cycle by flame as defined in claim 14, wherein the heat guiding pad further comprises a central circular plate, an enclosing frame having an outline corresponding to the base frame, and a plurality of connecting ribs connecting the central circular plate to the enclosing frame.

16. The ornamental device with a thermal cycle by flame as defined in claim 9, wherein the base frame is made of transparent material.

* * * * *